United States Patent [19]

Kopp et al.

[11] 4,415,257

[45] Nov. 15, 1983

[54] PRESSURE DEVICE FOR A WEB-LIKE IMAGE-RECEIVING MATERIAL

[75] Inventors: Walter Kopp, Taufkirchen; Hubert Mugrauer, Poering; Anton Stuerzer, Grafing, all of Fed. Rep. of Germany

[73] Assignee: Siemens Aktiengesellschaft, Berlin & Munich, Fed. Rep. of Germany

[21] Appl. No.: 394,501

[22] Filed: Jul. 2, 1982

[30] Foreign Application Priority Data

Jul. 22, 1981 [DE] Fed. Rep. of Germany ..... 3128983

[51] Int. Cl.[3] ..... G03G 15/16

[52] U.S. Cl. ..... 355/3 TR; 355/3 R

[58] Field of Search ..... 355/3 TR, 3 TE, 3 R, 355/14 R, 3 DD, 10

[56] References Cited

U.S. PATENT DOCUMENTS

| | | | |
|---|---|---|---|
| 4,131,358 | 12/1978 | Windele | 355/3 TR |
| 4,171,899 | 10/1979 | Yanagawa et al. | 355/3 TR |
| 4,257,700 | 3/1981 | Tsuda et al. | 355/3 TR |
| 4,306,800 | 12/1981 | Kopp | 355/3 TR |

FOREIGN PATENT DOCUMENTS

| | | | |
|---|---|---|---|
| 3109036 | 1/1982 | Fed. Rep. of Germany | 355/3 TR |
| 54-1036 | 1/1979 | Japan | 355/3 TR |
| 55-76367 | 6/1980 | Japan | 355/3 TR |

*Primary Examiner*—Richard L. Moses

*Attorney, Agent, or Firm*—Hill, Van Santen, Steadman & Simpson

[57] ABSTRACT

A pressure device for applying pressure to a web-like image-receiving material, such as a continuous paper web in the transfer station of a non-mechanical printer or copier, has a C-shaped pressure bar which extends over the width of the image-receiving material and is open on a side adjacent to the image-receiving material and which is pivotable about a point disposed above the pressure bar, and a solenoid having a movable plunger which is connected via a linkage to a pin carried on the rear of the pressure plate such that when the solenoid is in a normal rest condition the pressure bar is forced against the image-receiving material such that the image-receiving material presses against the surface of a rotating intermediate image carrier having an electrostatically held toner image thereon for transferring the image to the image-receiving material. When the solenoid is actuated, the plunger retracts thereby pulling the pressure bar away from the image-receiving material by rotating the pressure bar about its pivot point. The pressure bar may also include an eccentric disc having a pin engaging the linkage so that the movement of the pressure bar is retarded as the pressure bar moves toward or away from the image-receiving material.

7 Claims, 4 Drawing Figures

PRESSURE DEVICE FOR A WEB-LIKE IMAGE-RECEIVING MATERIAL

BACKGROUND OF THE INVENTION

1. Field of the Invention

The present invention relates to devices for applying pressure to a web-like image-receiving material, and in particular to such a device for applying pressure to a continuous moving paper web in the transfer station of a non-mechanical printer or copier.

2. Description of the Prior Art

An image which is to be reproduced in a non-mechanical printer or copier such as, for example, a graphic image, is first generated on an intermediate image carrier in the printer or copier and in a printing or transfer station is then transferred to image-receiving material, such as a continuously moving paper web. The intermediate image carrier generally consists of a rotating roller having an outer surface which carries a toner image held in place by electrostatic charge. In order that the image may be transferred to the paper, the paper must contact the roller with no slippage between the roller surface and the paper web in the transfer zone of the copier so that the image is not smeared. The prevention of slippage is particularly crucial in the reproduction or printing of graphic images. During pauses between image transfers, the paper web is raised from the roller surface and remains stationary.

The intermediate image carrier may also be in the form of a foil which in the region of the printing zone passes about a roller for transferring the image to the paper, however, the principle of operation and the associated problems, are the same as described above. A device for pressing and lifting an image receiving material such as a paper web toward and away from an intermediate image carrier is described in German AS No. 2,903,265 which further comprises a transportation device for periodically transporting the paper web. This pressure device consists of a polarized solenoid having a movable pin which is connected to the armature of the solenoid and which is also attached to a pressure bar which extends along the entire width of the paper web at a right angle to the direction of transport of the paper web. The pressure bar has a generally C-shaped cross section. The pressure bar has two flank ends which can be bent outward or inward in order to assure a slight frictional resistance relative to the moving paper web without the need for special manufacturing of the flank ends.

In this known pressure device, however, residual frictional resistance which occurs during pressure-applying movement of the pressure bar produces an additional force component which in fact largely counteracts the force exerted by the transportation device, which may be operating simultaneously, on the paper web. This force component hinders transportation of the paper web.

A further problem with conventional pressure-applying devices is that when the paper web comes into contact with the surface of the intermediate image carrier at a relatively high speed the toner image, which is held on the intermediate carrier surface by electrostatic forces, will become partially atomized.

SUMMARY OF THE INVENTION

It is an object of the present invention to provide a device for applying pressure to a moving paper web in the transfer station of a non-mechanical copier or printer for transferring an image from an intermediate image carrier to the paper in which the transport of the web is not inhibited.

It is a further object of the present invention to provide such a pressure-applying device which avoids smearing the image upon transfer of the image from the intermediate image carrier to the paper.

It is another object of the present invention to provide such a pressure-applying device which avoids atomization of the toner image on the intermediate image carrier as the paper is moved into contact therewith.

The above objects are inventively achieved in a device having a pivotable C-shaped pressure bar having an open side adjacent to the paper web which is connected to a movable plunger of a solenoid for urging the web against the surface of a rotating intermediate image carrier roller. The pressure bar is connected to the solenoid plunger by a linkage which is rigidly attached to the plunger at one end and which has a guide means which engages a pin carried on a flange attached to the pressure bar. When the solenoid plunger is in a rest state the pressure bar is pivoted against the paper web, thereby bringing the paper web into contact with the intermediate image carrier roller. Upon actuation of the solenoid, the plunger is withdrawn, thereby causing the pressure bar to pivot and move away from the paper web, thereby permitting the paper web to move out of contact with the intermediate image carrier roller.

In a second embodiment of the invention, the pressure bar has a second C-shaped member having an eccentric disc having an eccentric pin mounted thereon which engages the linkage such that when the solenoid plunger is extended the movement of the pressure bar as it approaches the paper web is retarded and similarly upon withdrawal of the solenoid plunger upon actuation of the solenoid the initial movement of the pressure bar away from the paper web is retarded, thus preventing atomization of the toner image on the intermediate image carrier. The remainder of the travel of the pressure bar is undertaken at a substantially faster speed.

DESCRIPTION OF THE PREFERRED EMBODIMENTS

A device for applying pressure to a moving paper web AT in the transfer or printing station of a non-mechanical copier or printer for urging the web AT against the surface of an intermediate image carrier ZT.

Figure 1:
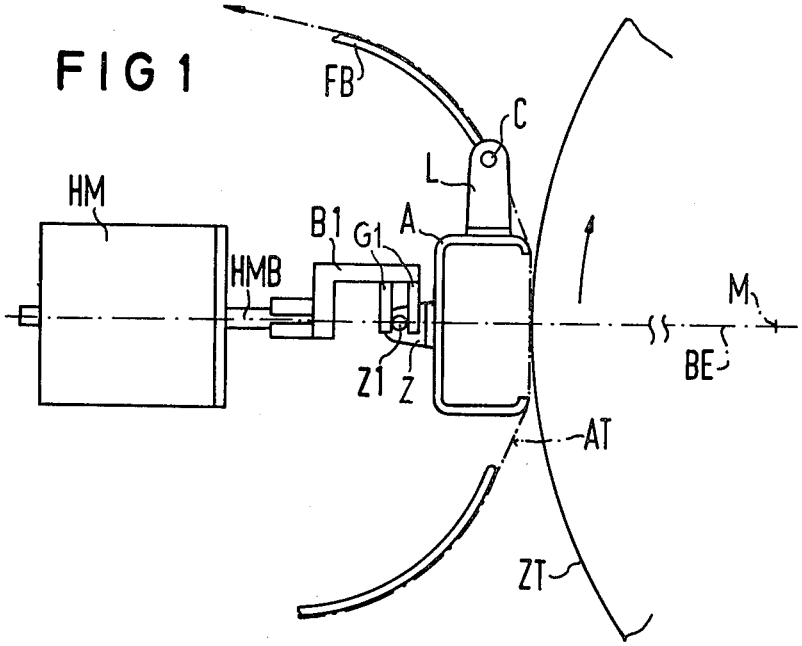
FIG. 1 is a side view of a pressure-applying device located at the transfer station of a non-mechanical printer or copier constructed in accordance with the pinciples of the present invention in a pressure-applying position.

The intermediate image carrier ZT is in the form of a roller which rotates about a central axis M. In the region in which the image-receiving material such as the paper web AT comes into contact with the intermediate image carrier ZT, toner images which are electrostatically held on the surface of the intermediate carrier ZT are transferred in a known manner to the image-receiving material AT. This region is therefore referred to as the transfer zone or the printing zone. The center of the transfer zone and the axis M of the rotating intermediate image carrier ZT define a reference plane BE, which is shown as a dash-dot straight line in FIG. 1. A pressure bar A which is symmetrical with respect to the reference plane BE is shown in FIG. 1 which has a C-shaped cross section and has an upper flange L which engages a pin C which is mounted at the beginning of a guide plate FB for the image-receiving material AT which emerges from the transfer station. The pressure bar A is thus pivotable about the pin C. At this point, the entirety of the guide plate FB is inclined such that when the pressure bar A is in the position shown in FIG. 1 the image-receiving material AT moves approximately tangential to the open side of the pressure bar A.

The pivoting movement of the pressure bar A is effected by means of a polarized solenoid HN having a solenoid plunger HMB which is rigidly attached to a linkage B1. The linkage B1 has a pair of parallel downwardly-extending guides G1 which surround a pin Z1 carried on a rear flange Z of the pressure bar A. The guides G1 are disposed perpendicular to the direction of movement of the solenoid plunger HMB and the pin Z1 extends perpendicular to the plane of the drawing. The guides G1 permit vertical movement of the pin Z1, that is, movement perpendicular to the plane BE, but limit lateral movement of the pin Z1.

Figure 3:
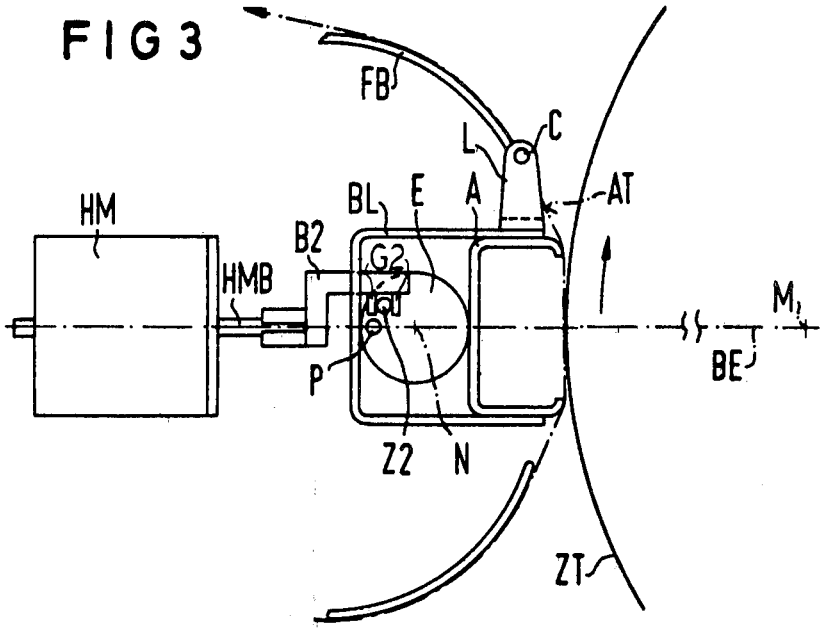
FIG. 3 is a side view of a pressure-applying device located at the transfer station of a non-mechanical printer or copier constructed in accordance with the principles of the present invention in a pressure-applying position in an embodiment which retards movement of the device as it approaches and receives from the paper.
Figure 4:
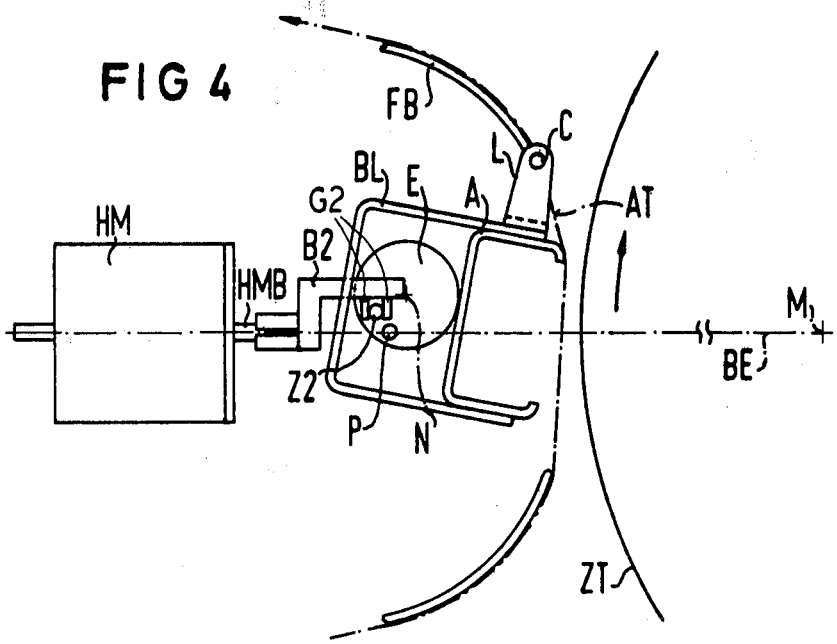
FIG. 4 is a side view of the pressure-applying device of FIG. 3 in a retracted position.

As shown in FIG. 1, the axis of the solenoid plunger HMB is coincident with the reference plane BE, however, this is not a necessary condition in this embodiment, or the embodiment shown in FIGS. 3 and 4, as long as movement of the solenoid plunger HMB is approximately parallel to the reference plane BE.

The same arrangement as described in connection with FIG. 1 is shown in a retracted condition in FIG. 2 after actuation of the solenoid HM which has caused withdrawal of the plunger HMB. In the condition shown in FIG. 2, the withdrawal of the plunger HMB pulls the pressure bar A away from the image-receiving material AT such that the pin Z1 rises within the guides G1 and the pressure bar A pivots about the pin C, so that the image-receiving material AT is no longer in contact with the surface of the intermediate image carrier ZT.

Figure 2:
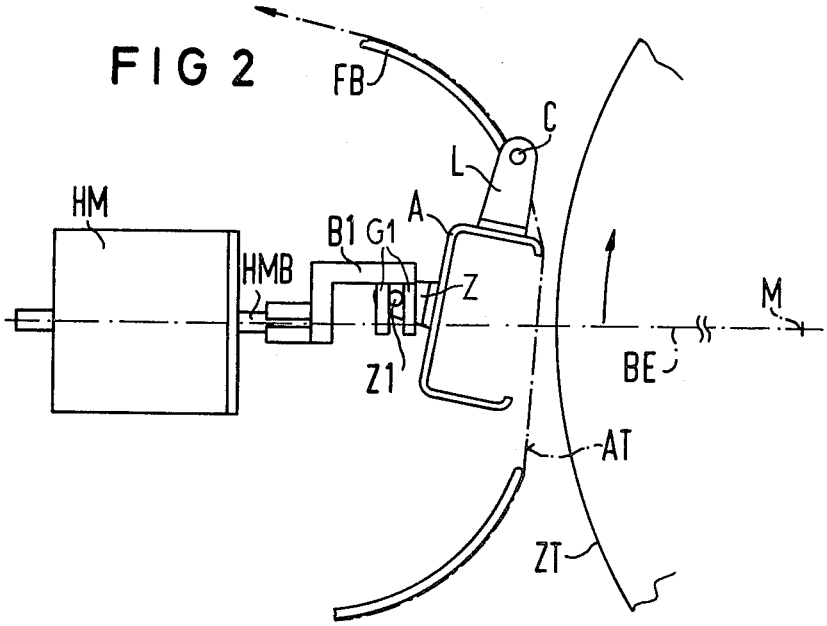
FIG. 2 is a side view of the device shown in FIG. 1 in a retracted position.

As can be seen in comparing the positions shown in FIG. 1 and FIG. 2, no change occurs in the distance between the beginning of the guide plate FB and the outer ends of the pressure bar A against which the image-receiving material AT rests, in contrast to conventional linear feed movements. If, for example, it is assumed that the image-receiving material AT, which under normal circumstances runs in a substantially straight line when the pressure bar A is pivoted against the image-receiving material AT, should come to a halt and is thus maintained in a stationary position in the transfer station, no relative movement would occur between the image-receiving material AT and the pressure bar A, so that the image would not be smeared upon transfer to the image-receiving material AT.

In the embodiment shown in FIGS. 1 and 2, the image-receiving material AT comes into contact with the surface of the intermediate image carrier ZT at a relatively high speed. As discussed above, this presents the possibility of partial atomization of the toner image which is on the surface of the carrier ZT.

An embodiment of the present invention which substantially eliminates the possibility of atomization of the toner image on the surface of the carrier ZT is shown in FIGS. 3 and 4. Elements common to those already identified in FIG. 1 and FIG. 2 are identically referenced. In the embodiment of FIGS. 3 and 4, the movement of the pressure bar A as it nears the end of its approach toward the image-receiving material AT is slightly retarded, however, the overall approach time is not noticeably lengthened. Similarly, movement of the pressure bar A at the beginning of a retraction phase is slightly retarded as the pressure bar A is initially moved away from the image-receiving material AT and the image carrier ZT.

This retarded movement is achieved by an eccentric disc E which is mounted in an additional C-shaped element BL which is attached to the pressure bar A. The eccentric disc E has a center point N and rotates about a pivot point P. The disc E has an eccentrically mounted pin Z2 thereon which engages guides G2 of a linkage B2, which is in turn rigidly attached to the solenoid plunger HMB.

The linear movement of the solenoid pin HMB is thus translated into rotational movement by the pin Z2 which causes rotation of the eccentric disc E upon extention and withdrawal of the plunger HMB. The rotary movement of the eccentric disc E causes the pressure bar A to move more slowly as it approaches or retracts from the image-receiving material AT and the intermediate image carrier ZT so that the toner image thereon is not atomized. The device is shown in FIG. 3 in a pressure-applying condition and is shown in FIG. 4 in a retracted condition after actuation of the solenoid HM causing withdrawal of the solenoid plunger HMB.

In the position shown in FIG. 3, the center point N of the eccentric disc E is located in the reference plane BE. The line connecting the pivot point P and the center of the eccentric pin Z2 forms an angle with a vertical line which is perpendicular to the reference plane BE in the clockwise direction. In the retracted position shown in FIG. 4, the eccentric disc E has been rotated such that the pin Z2 has traversed an angle which is twice the angle described above, so that the pin Z2 in FIG. 4 occupies a position which again forms the angle, but in a counter-clockwise or negative direction measured from the vertical. This angle is preferably in the range of 30° to 40°.

For a given angle the necessary distance of the pin Z2 from the axis of rotation P is dependent only upon the operating range of the solenoid plunger HMB and the linkage B2. As can easily be seen from FIG. 3, a slight rotation of the eccentric disc E out of the rest position toward the position shown in FIG. 4 does not result in any noticeable pivoting movement of the pressure bar A because the distance between the point at which the eccentric disc E is in contact with the pressure bar A from the axis of rotation P changes initially only slightly. This applies as well in reverse to the last phase of an approach movement.

In this manner the beginning and concluding movement phases of the pressure bar A can be influenced by the selection of the angle which is formed between the reference plane BE and the plane which runs through the axis of rotation P and the center point N when the eccentric disc E occupies the position shown in FIG. 3. An increase in this angle will result in a proportionate reduction in the amount of speed retardation which is achieved in the embodiment shown in FIGS. 3 and 4.

Although modifications and changes may be suggested by those skilled in the art it is the intention of the inventors to embody within the patent warranted hereon all changes and modifications as reasonably and properly come within the scope of their contribution to the art.

We claim as our invention:

1. A device for use in a transfer station of a non-mechanical printer or copier for moving a continuous web-like image-receiving material toward and away from an intermediate image carrier comprising:

a C-shaped pressure bar extending over the width of said image-receiving material and having an open side adjacent to said image-receiving material, said pressure bar being pivotally connected to said guide plate at a point above said pressure bar, and having a means mounted on a rear of said pressure bar carrying a pin thereon;

a plunger-type solenoid; and a linkage rigidly connected to the plunger of said solenoid and having a pair of parallel guides disposed perpendicular to the direction of displacement of said plunger of said solenoid, said guides defining a slot in which said pin is received permitting movement of said pin within said slot, whereby said open side of said pressure bar is urged against said image-receiving material when said solenoid is in a rest condition, and whereby said pressure bar is pivoted about said pivot point upon actuation of said solenoid and retraction of said plunger such that said pressure bar is moved away from said image-receiving material.

2. The device of claim 1 wherein said means mounted at a rear of said pressure bar is a flange having said pin mounted thereon.

3. The device of claim 1 wherein said means mounted at a rear of said pressure bar comprises:

a C-shaped housing connected to said pressure bar; and an eccentric disc mounted in said housing in contact with said pressure bar having said pin eccentrically mounted thereon such that displacement of said solenoid plunger causes rotation of said eccentric disc thereby retarding the speed of movement of said pressure bar as said pressure bar approaches or recedes from said image-receiving material.

4. The device of claim 3 wherein said eccentric disc has a center point and an eccentric pivot point, and wherein said center point and said eccentric pivot point are disposed in a plane which horizontally bisects said pressure bar.

5. The device of claim 3 wherein said eccentric disc has an eccentric pivot point and wherein said pin is disposed at an angle with respect to a vertical line containing said eccentric pivot point and wherein said pin moves through twice said angle as said pressure bar is moved from a rest position to a retracted position upon actuation of said solenoid.

6. The device of claim 5 wherein said angle is in the range of 30° to 40°.

7. The device of claim 1 wherein said pivot point is disposed at an end of said guide plate and wherein a beginning of said open side of said pressure bar is disposed on a line which is tangent to said end of said guide plate.

* * * * *